US007046222B2

(12) United States Patent
Kim et al.

(10) Patent No.: US 7,046,222 B2
(45) Date of Patent: May 16, 2006

(54) SINGLE-SCAN DRIVER FOR OLED DISPLAY

(75) Inventors: Chang Oon Kim, Seoul (KR); Keunmyung Lee, Palo Alto, CA (US)

(73) Assignee: Leadis Technology, Inc., Sunnyvale, CA (US)

( * ) Notice: Subject to any disclaimer, the term of this patent is extended or adjusted under 35 U.S.C. 154(b) by 145 days.

(21) Appl. No.: 10/232,575

(22) Filed: Aug. 30, 2002

(65) Prior Publication Data

US 2003/0112207 A1 Jun. 19, 2003

Related U.S. Application Data

(60) Provisional application No. 60/342,020, filed on Dec. 18, 2001.

(51) Int. Cl.
*G09G 3/32* (2006.01)

(52) U.S. Cl. ..... 345/82; 345/100

(58) Field of Classification Search ..... 345/39, 345/80, 82, 83, 76, 100; 315/169.3
See application file for complete search history.

(56) References Cited

U.S. PATENT DOCUMENTS

| | | | | |
|---|---|---|---|---|
| 5,170,158 | A | 12/1992 | Shinya | |
| 5,420,604 | A | 5/1995 | Scheffer et al. | |
| 5,572,211 | A | 11/1996 | Erhart et al. | |
| 5,684,502 | A | 11/1997 | Fukui et al. | |
| 5,689,280 | A | 11/1997 | Asari et al. | |
| 5,747,363 | A | 5/1998 | Wei et al. | |
| 5,751,263 | A * | 5/1998 | Huang et al. | 345/82 |
| 5,754,157 | A | 5/1998 | Kuwata et al. | |
| 5,764,212 | A | 6/1998 | Nishitani et al. | |
| 5,786,799 | A | 7/1998 | Matsui et al. | |
| 5,812,105 | A * | 9/1998 | Van de Ven | 345/83 |
| 5,818,409 | A | 10/1998 | Furuhashi et al. | |
| 5,852,429 | A | 12/1998 | Scheffer et al. | |
| 5,877,738 | A | 3/1999 | Ito et al. | |
| 5,900,856 | A | 5/1999 | Iino et al. | |
| 6,040,815 | A | 3/2000 | Erhart et al. | |
| 6,252,572 | B1 | 6/2001 | Kurumisawa et al. | |
| 6,320,562 | B1 * | 11/2001 | Ueno et al. | 345/87 |
| 6,366,026 | B1 * | 4/2002 | Saito et al. | 315/169.3 |
| 6,417,827 | B1 | 7/2002 | Nagao et al. | |
| 6,483,497 | B1 | 11/2002 | Iino et al. | |
| 6,522,317 | B1 | 2/2003 | Satou et al. | |
| 6,611,246 | B1 | 8/2003 | Ito et al. | |
| 6,778,154 | B1 * | 8/2004 | Van Velzen | 345/76 |
| 6,803,890 | B1 * | 10/2004 | Velayudhan et al. | 345/76 |
| 6,947,022 | B1 * | 9/2005 | McCartney | 345/99 |
| 6,972,745 | B1 * | 12/2005 | Pfeiffer et al. | 345/89 |
| 2001/0028346 | A1 | 10/2001 | Kudo et al. | |
| 2001/0038385 | A1 | 11/2001 | Negoi et al. | |
| 2001/0050662 | A1 | 12/2001 | Kota et al. | |
| 2002/0018060 | A1 | 2/2002 | Yamazaki et al. | |

(Continued)

FOREIGN PATENT DOCUMENTS

EP 0837446 A1 4/1998

(Continued)

*Primary Examiner*—Amare Mengistu
(74) *Attorney, Agent, or Firm*—Fenwick & West LLP

(57) ABSTRACT

A single scan driver for an organic light emitting diode (OLED) display is disclosed, that can reduce the required power consumption. By connecting together both ends of each column line so that a single driver circuit can drive both ends of each column line together, the column line resistance is reduced, resulting in a significant reduction in power consumption.

9 Claims, 5 Drawing Sheets

U.S. PATENT DOCUMENTS

2002/0060655 A1* 5/2002 Moon ..... 345/87
2002/0084965 A1* 7/2002 Park ..... 345/87
2002/0097002 A1* 7/2002 Lai et al. ..... 315/169.3
2002/0149608 A1 10/2002 Bu et al.
2002/0158585 A1* 10/2002 Sundahl ..... 315/169.3
2003/0011298 A1* 1/2003 Palanisamy ..... 313/495
2003/0063077 A1* 4/2003 Koyama ..... 345/204
2005/0206598 A1* 9/2005 Yamazaki et al. ..... 345/87

FOREIGN PATENT DOCUMENTS

JP 2000-172236 A 6/2000
JP 2000-258751 A 9/2000

* cited by examiner

SINGLE-SCAN DRIVER FOR OLED DISPLAY

RELATED APPLICATION

This application claims the benefit of co-pending U.S. Provisional application Ser. No. 60/342,020, filed Dec. 18, 2001, entitled "Single-Scan Driver for OLED Display."

BACKGROUND OF THE INVENTION

1. Technical Field

This invention in general relates to semiconductor circuits and flat panel display modules. More specifically, this invention relates to circuits for driving columns of organic light emitting diode (OLED) displays.

2. Description of the Related Art

An organic light emitting diode (OLED) display is made up of rows and column electrodes for selectively activating the OLED device at each intersection. FIG. 1 shows a conventional single scan driving scheme where an OLED panel 10 is driven by a row driver 11 that drives row electrodes an a column driver 12 that drives column electrodes. The row electrodes are scanned in sequence to refresh the display image.

As the OLED display becomes larger with an increased number of row electrodes, the resistance of the column electrodes increases, which, in turn, increases the power dissipation along the columns.

There is a dual scan scheme where a flat panel display is divided into two parts, an upper panel and a lower panel, and there are two column drivers, each of which is responsible for driving each half panel. The dual scan scheme helps reduce the power consumption by reducing the resistance of column electrodes by 50%. However, the dual scan scheme has the problem of non-uniformity of brightness across the boundary between the upper and lower panels.

Therefore, there is a need for a new single scan scheme that can drive an OLED display with less power consumption without dividing the panel.

SUMMARY OF THE INVENTION

It is an object of the present invention to provide a single scan driving scheme for an OLED display with reduced power consumption.

Another object of the present invention is to provide a single scan driving scheme that can drive an OLED display with a reduced voltage.

The foregoing and other objects are accomplished by providing a single scan driving scheme using a column driver whose outputs connect to both sides of the OLED panel so as to reduce the column line load resistance of the panel. The power dissipation is reduced as a result as well as the required column driving voltage.

DETAILED DESCRIPTION OF THE INVENTION

Figure 1:
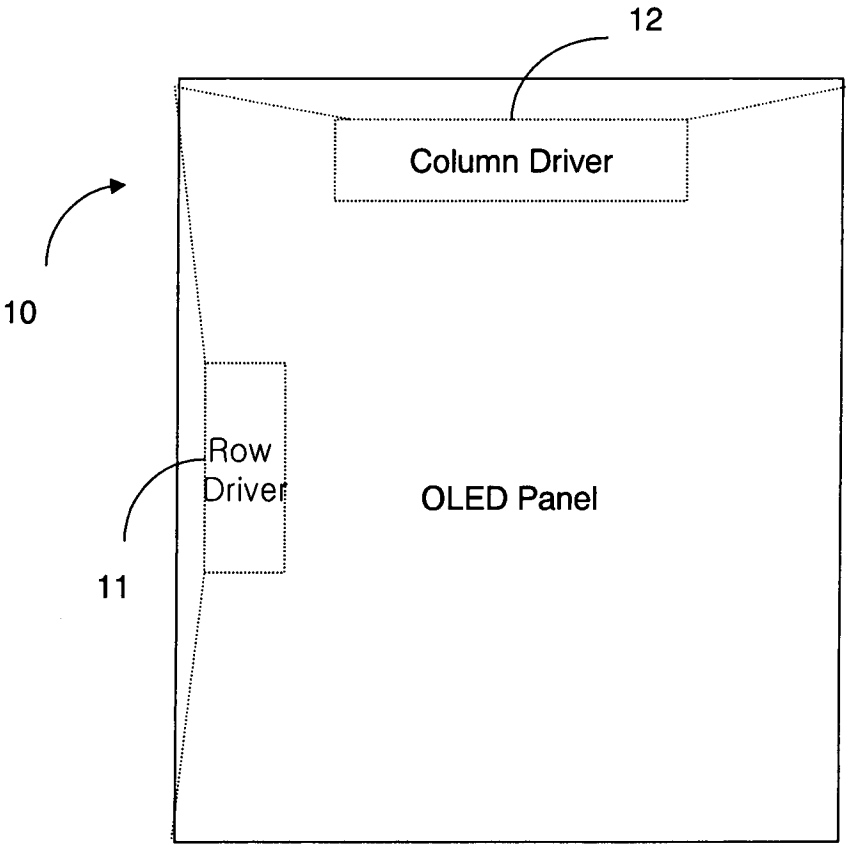
FIG. 1 shows a conventional single scan driving scheme for driving an OLED display.
Figure 2:
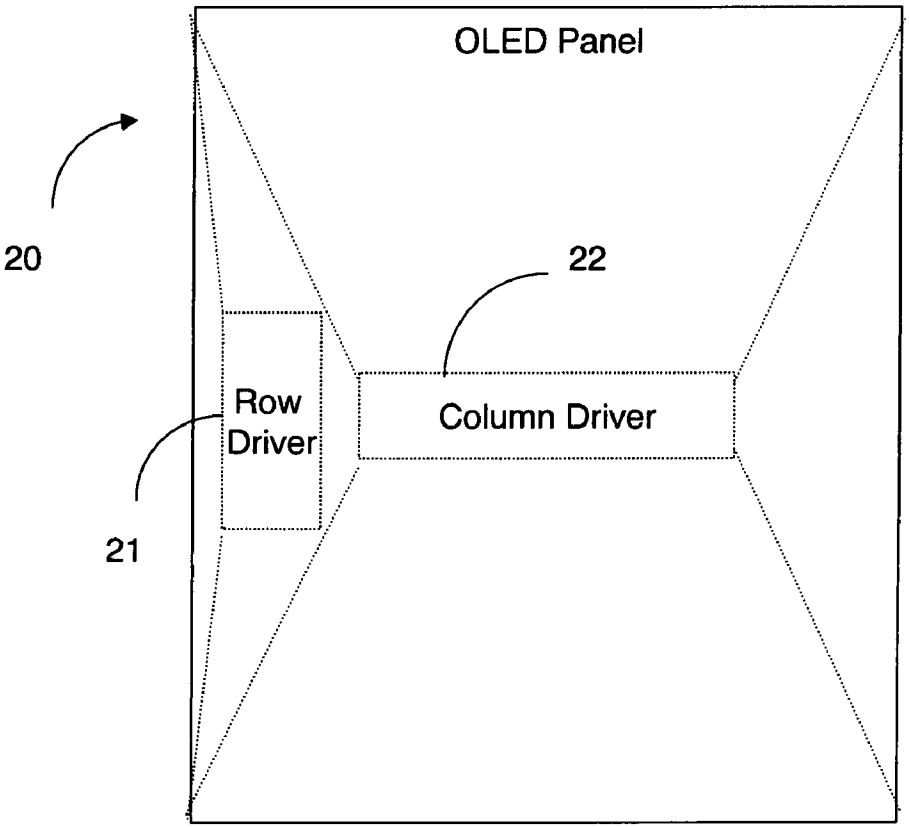
FIG. 2 shows a new single scan driving scheme of the present invention using one column driver whose outputs connect both sides of the OLED panel.

FIG. 2 shows the present invention where an OLED panel 20 is driven by a row driver 21 that drives row electrodes and a column driver 22, preferably located at the center, that drives both ends of the column electrodes. Because each column line is driven at both sides, the column line resistance is reduced as much as ¼ of that driven by one side only.

Figure 3:
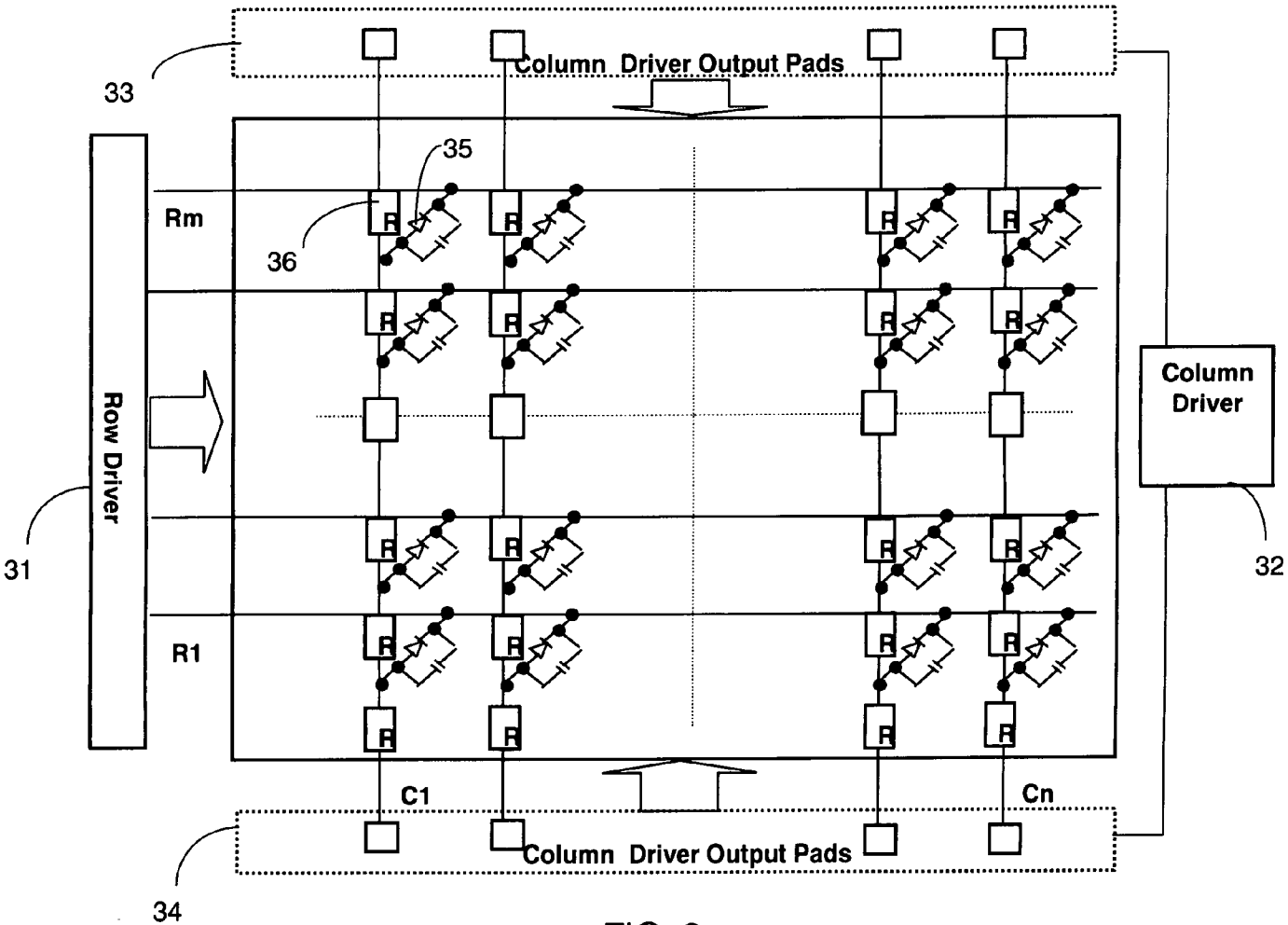
FIG. 3 shows an equivalent circuit of an OLED panel.

FIG. 3 shows an equivalent circuit of an OLED panel consisting of m number of row electrodes and n number of column electrodes with a row driver 31 for driving the row electrodes and a column driver 32 whose output pads 33 and 34 are connected at both top and bottom sides respectively for driving the column electrodes. At each intersection of the row and column electrodes are a diode 35 representing an organic LED and R 36 representing the resistance for a row-pitch segment of each column.

Let Cx represent the number of columns, Iout the output driver current. The voltage for driving the OLED display, Voled, where each column line is driven from a single end, is expressed as follows:

$$Voled = (Iout*Cx*Ron)+Vd+Vt+(Rload*Iout)$$

where Ron is the output resistance of a selected row; Vd is the diode-on voltage of OLED, which is around 2.5 to 3.5 volts; Vt is the voltage across an output transistor, which ranges 2–4 volts; and Rload is the resistance of the column line.

The present invention reduces the column line resistance Rload as much as up to ¼ of the value by connecting together both ends of each column line so as that each end of the column line is at an equal potential driven by a single driving circuit. Then, the voltage for driving the OLED display Voled where each column line is driven from both ends is expressed as follows:

$$Voled=(Iout*Cx*Ron)+Vd+Vt+(0.25Rload*Iout)$$

The max power dissipation in the column driver, Pc, is expressed as:

$$\begin{aligned} Pc &= (Iout*Cx)*(Voled-(Iout*Ron*Cx)-0.25\ Rload* \\ &\quad Iout-Vd) \\ &= (Iout*Cx)*Vt \end{aligned}$$

The max power dissipation in the row driver, Pr, is expressed as:

$$Pr=(Iout*Cx)*(Iout*Cx)*Ron$$

The total max power dissipation P in both row and column drivers is expressed as follows:

$$P=(Iout*Cx)*Voled$$

Figure 4A:
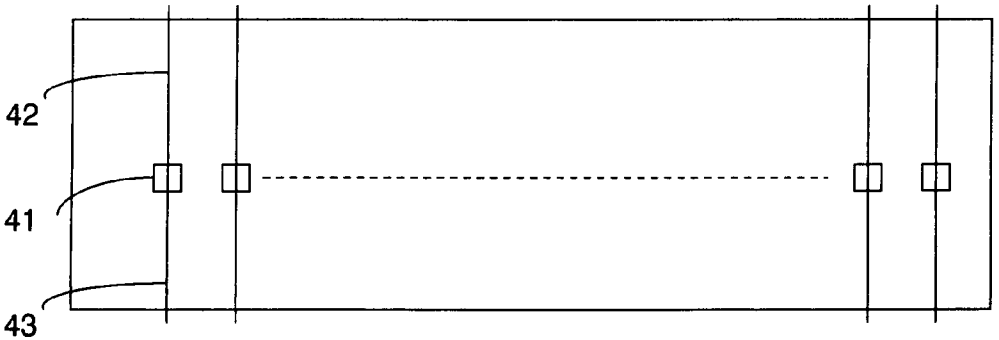
FIGS. 4A and 4B show two arrangements of the output pads of the column driver.
Figure 4B:
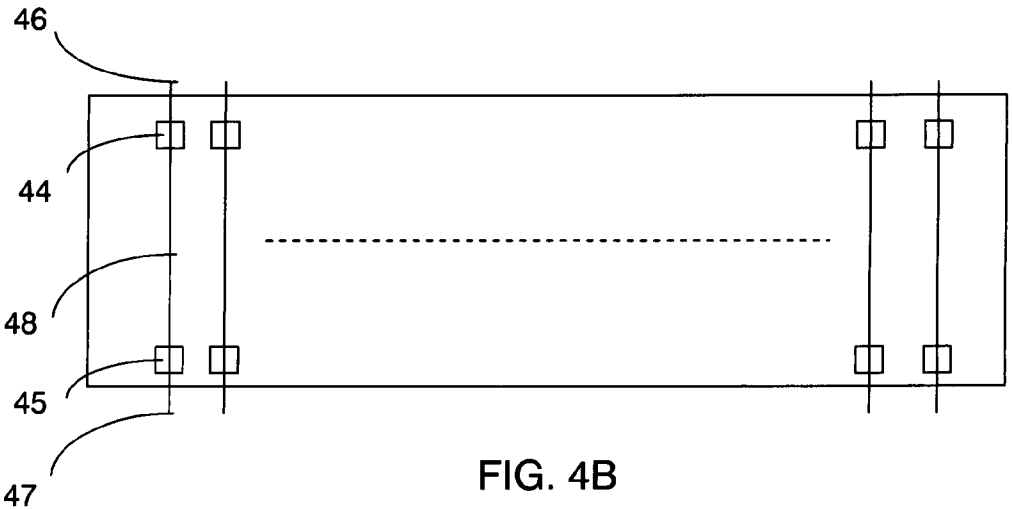

FIG. 4A shows one arrangement of the output pads of the column driver. The output pads such as 41 are located at the center, from which output leads 42 and 43 extend to upper and lower sides. FIG. 4B shows another arrangement of output pads where output pads such as 44 and 45 are located at the upper and lower boundaries, each having its own output lead such as 46 and 47 extending to the respective side. Each corresponding pair of pads such as 44 and 45 are made to short each other by 48.

Figure 5:
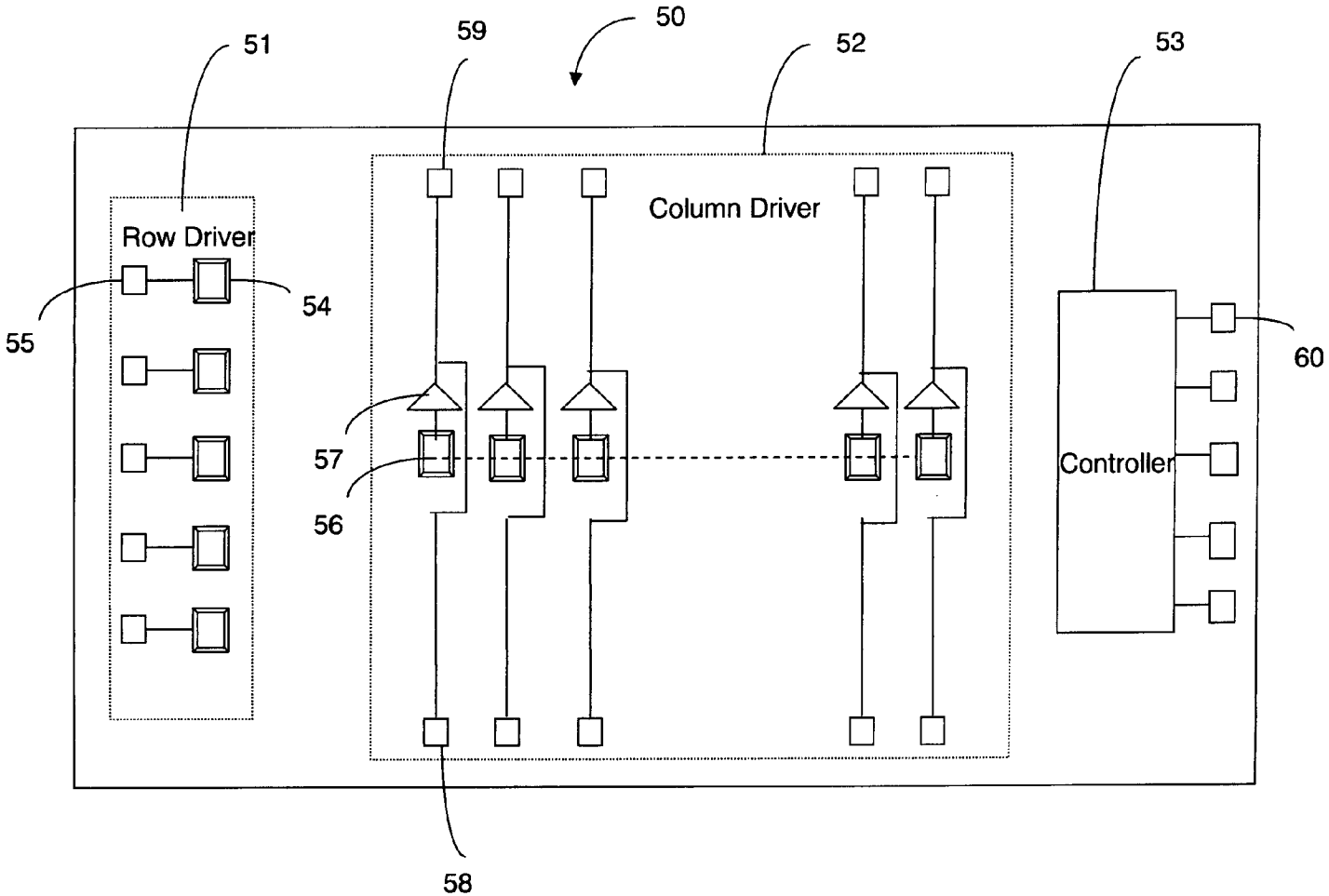
FIG. 5 shows a single chip solution integrating both the row driver and column driver as well as a controller for controlling the row and column drivers.

FIG. 5 shows a single chip solution as an alternative embodiment, where a single chip 50 includes both a row driver 51 having a driver circuit such as 54 and output pads such as 55, and a column driver 52 having a driver circuit such as 56, a buffer such as 57, and output pads such as 58 and 59 for driving a single-scan OLED display. It may further include a controller 53 with input pads such as 60 for providing control information to the row and column drivers. The single chip 50 may be designed to further include memory cells for storing graphics data and power circuits (not shown in the figure).

While the invention has been described with reference to preferred embodiments, it is not intended to be limited to those embodiments. It will be appreciated by those of ordinary skilled in the art that many modifications can be made to the structure and form of the described embodiments without departing from the spirit and scope of this invention.

What is claimed is:

1. A driver for driving columns of a single-scan LED (Light-Emitting Diode) panel including a plurality of row and column electrodes, comprising:

driver circuitry for driving the column electrodes;

a first set of output leads from the driver circuitry extending to a top end of the panel to connect to a first end of the column electrodes; and a second set of output leads from the driver circuitry extending to a bottom end of the panel to connect to a second end of the column electrodes;

wherein both the first and second ends of each column electrode are driven at a same potential by the driver circuitry via one of the first set of output leads and one of the second set of output leads, respectively, whereby a resistance along each column electrode is reduced.

2. The driver of claim 1, wherein the LED panel is an OLED (Organic Light-Emitting Diode) panel.

3. The driver of claim 1, wherein the driver circuitry is located substantially at the center in the back side of the panel.

4. A single-scan LED (Light-Emitting Diode) panel, comprising:

row electrodes;

column electrodes, each having a first end and a second end;

a plurality of LEDs each coupled to one of the row electrodes and one of the column electrodes at each intersection of the row electrodes and the column electrodes;

driver circuitry for driving the column electrodes;

a first set of output leads from the driver circuitry extending to a top end of the panel to connect to the first end of the column electrodes; and a second set of output leads from the driver circuitry extending to a bottom end of the panel to connect to the second end of the column electrodes;

wherein both the first and second ends of each column electrode are driven at a same potential by the driver circuitry via one of the first set of output leads and one of the second set of output leads, respectively, whereby a resistance along each column electrode is reduced.

5. The LED panel of claim 4, wherein the LED panel is an OLED (Organic Light-Emitting Diode) panel.

6. The LED panel of claim 4, wherein the driver circuitry is located substantially at the center in the back side of the panel.

7. A method of driving columns of a single-scan LED (Light-Emitting Diode) panel including a plurality of row and column electrodes, comprising:

providing driver circuitry;

extending a first set of output leads from the driver circuitry to a top end of the panel to connect to a first end of the column electrodes;

extending a second set of output leads from the driver circuitry to a bottom end of the panel to connect to a second end of the column electrodes; and driving both the first and second ends of each column electrode at a same potential by the driver circuitry via one of the first set of output leads and one of the second set of output leads, respectively, whereby a resistance along each column electrode is reduced.

8. The method of claim 7, wherein said LED panel is an OLED (Organic Light-Emitting Diode) panel.

9. The method of claim 7, wherein the driver circuitry is located substantially at the center in the back side of the panel.

* * * * *